US010569125B2

(12) United States Patent
Schindler-Ivens et al.

(10) Patent No.: US 10,569,125 B2
(45) Date of Patent: Feb. 25, 2020

(54) MOTOR ASSISTED SPLIT-CRANK PEDALING DEVICE

(71) Applicant: Marquette University, Milwaukee, WI (US)

(72) Inventors: Sheila Schindler-Ivens, Shorewood, WI (US); Brian D. Schmit, Brookfield, WI (US); Domenic Busa, Madison, WI (US)

(73) Assignee: Marquette University, Milwaukee, WI (US)

( * ) Notice: Subject to any disclaimer, the term of this patent is extended or adjusted under 35 U.S.C. 154(b) by 80 days.

(21) Appl. No.: 15/970,503

(22) Filed: May 3, 2018

(65) Prior Publication Data

US 2019/0001184 A1 Jan. 3, 2019

Related U.S. Application Data

(60) Provisional application No. 62/527,533, filed on Jun. 30, 2017.

(51) Int. Cl.
*A63B 22/06* (2006.01)
*A63B 22/00* (2006.01)

(52) U.S. Cl.
CPC ..... *A63B 22/0605* (2013.01); *A63B 22/0017* (2015.10); *A63B 22/0025* (2015.10);
(Continued)

(58) Field of Classification Search
CPC ..... A63B 22/0605; A63B 22/0017; A63B 22/0025; A63B 2022/0038;
(Continued)

(56) References Cited

U.S. PATENT DOCUMENTS 5,165,278 A 11/1992 Huszczuk et al.
5,421,798 A 6/1995 Bond et al.
(Continued)

FOREIGN PATENT DOCUMENTS

EP 2564904 3/2013
RU 2421366 C1 6/2011
(Continued)

OTHER PUBLICATIONS

Kautz et al. "Interlimb influences on paretic leg function in poststroke hemiparesis." (2005) J Neurophysiol 92:2460-2473.
(Continued)

*Primary Examiner* — Garrett K Atkinson
(74) *Attorney, Agent, or Firm* — Andrus Intellectual Property Law, LLP

(57) ABSTRACT

Split-crank pedaling devices and methods of operation support patient use and rehabilitation, particularly for stroke patients. A split-crank pedaling device includes first and second crank assemblies. First and second motors are operably connected to the first and second crank assemblies. A first shaft sensor produces an indication of a position of the shaft of the first crank assembly. A second shaft sensor produces an indication of a position of the shaft of the second crank assembly. A controller is communicatively connected to the first and second motors and the first and second shaft sensors and calculates a phase error between the positions of the first and second shafts and a predetermined phase relationship between the first and second shafts. The controller operates at least one of the first motor or the second motor to provide a supplemental torque to one of the first crank assembly and the second crank assembly.

20 Claims, 7 Drawing Sheets

(52) U.S. Cl.
CPC ..... *A63B 2022/0038* (2013.01); *A63B 2022/0094* (2013.01); *A63B 2022/0617* (2013.01); *A63B 2220/16* (2013.01); *A63B 2220/34* (2013.01); *A63B 2220/44* (2013.01); *A63B 2220/54* (2013.01); *A63B 2230/045* (2013.01); *A63B 2230/105* (2013.01)

(58) Field of Classification Search
CPC .... A63B 2022/0094; A63B 2022/0617; A63B 2220/34; A63B 2220/44; A63B 2220/54; A63B 2230/045; A63B 2230/105; A63B 2220/16; A63B 21/00181; A63B 2071/0652; A63B 2220/805; A63B 21/0058; A63B 23/0417; A63B 22/001; A63B 22/0012; A63B 22/0056; A63B 22/06; A63B 22/201; A63B 21/0051; A63B 21/00192; A63B 2208/0204; A63B 2208/0233; A63B 2022/206; A63B 2022/0041; A63B 2022/0051; A63B 21/225; A63B 2022/0688
See application file for complete search history.

(56) References Cited

U.S. PATENT DOCUMENTS

| | | | | |
|---|---|---|---|---|
| 6,234,939 | B1 * | 5/2001 | Moser | A63B 22/0007 482/57 |
| 7,267,637 | B2 | 9/2007 | Mercado et al. | |
| 7,588,518 | B2 | 9/2009 | LaStayo et al. | |
| 7,648,446 | B2 | 1/2010 | Chiles et al. | |
| 7,727,125 | B2 * | 6/2010 | Day | A63B 21/015 482/5 |
| 8,079,937 | B2 | 12/2011 | Bedell et al. | |
| 8,545,420 | B2 | 10/2013 | Einav et al. | |
| 8,602,943 | B2 * | 12/2013 | Andreasen | A61H 1/0214 482/1 |
| 9,044,630 | B1 | 6/2015 | Lampert et al. | |
| 9,205,300 | B2 | 12/2015 | Ishii et al. | |
| 9,265,988 | B2 | 2/2016 | van der Merwe | |
| 9,586,091 | B2 | 3/2017 | Reich et al. | |
| 9,802,081 | B2 | 10/2017 | Ridgel et al. | |
| 2004/0204293 | A1 * | 10/2004 | Andreasen | A63B 21/00178 482/52 |
| 2005/0107221 | A1 * | 5/2005 | Vohryzka | A63B 22/0007 482/57 |
| 2006/0247095 | A1 * | 11/2006 | Rummerfield | A61H 1/0214 482/1 |
| 2007/0298935 | A1 * | 12/2007 | Badarneh | A63B 22/001 482/52 |
| 2010/0173747 | A1 * | 7/2010 | Chen | A63B 22/0002 482/5 |
| 2012/0316035 | A1 * | 12/2012 | Andreasen | A61H 1/0214 482/7 |
| 2013/0137550 | A1 * | 5/2013 | Skinner | A63B 24/0087 482/5 |

FOREIGN PATENT DOCUMENTS

| | | |
|---|---|---|
| WO | 2017158455 | 9/2017 |
| WO | 2017129275 | 10/2017 |

OTHER PUBLICATIONS

Van Der Loos et al. "A split-crank, servomotor-controlled bicycle ergometer design for studies in human biomechanics." Intl. conference on Intelligent Robots and Systems, EPFL, Lausanne, Switzerland. (Oct. 2002).
International Search Report and Written Opinion for PCT/US2018/030919 dated Sep. 6, 2018.

* cited by examiner

MOTOR ASSISTED SPLIT-CRANK PEDALING DEVICE

CROSS-REFERENCE TO RELATED PATENT APPLICATIONS

This application claims the benefit of priority to U.S. Provisional Application No. 62/527,533, filed on Jun. 30, 2017, the content of which is incorporated by reference in its entirety.

STATEMENT REGARDING GOVERNMENT SPONSORED RESEARCH OR DEVELOPMENT

This invention was made with government support under Grant No. 01HD060693 awarded by the National Center for Medical Rehabilitation Research in the Eunice Kennedy Shriver National Institute of Child Health and Human Development. The U.S. Government has certain rights in this invention.

BACKGROUND

Conventional pedaling devices (e.g. bicycles, stationary bicycles) have a crank that includes a shaft that provides a mechanical connection between right and the left arms. In operating the crank, force applied to one arm moves the other arm via force transmitted through the shaft.

People who have suffered from a stroke can exhibit at least two problems when using their lower limbs. Patients may underutilize the paretic limb. Patients may also have difficulty properly coordinating the output of the paretic and non-paretic limbs. When stroke patients pedal a conventional pedaling device with a mechanical connection between the two arms, often the non-paretic limb will be relied upon to turn the crank to move the paretic limb. This strategy is advantageous to stroke patients because it allows them to complete the pedaling task. However, by completing the task in this manner, stroke patients fail to improve the motor output of the paretic limb and do not learn to coordinate the output of the paretic and non-paretic limbs. Consequently, motor recovery may be impeded.

Reliance upon the non-paretic limb can be addressed by "uncoupling" or "splitting" the crank at the shaft. When the crank shaft is split, the mechanical connection between the paretic and non-paretic limbs is eliminated. Thus, to pedal successfully, the paretic limb must generate force, and movement of each limb must be properly coordinated. In this manner, both challenges for stroke patients should be rehabilitated and improved with practice.

However, this solution is not available in clinical practice as split crank pedaling can be challenging to even people without stroke and can be too difficult to accomplish for some stroke patients. Due to the difficulty of even completing the motions with both paretic and non-paretic limbs, patients can become frustrated and quit treatment due to their inability to perform the requested tasks. Even when patients may continue with the treatment, the patients may repeatedly fail the task or exhibit such poor form or improper movement that the patients do not receive the desired movement practice or rehabilitation. Thus, the physical tasks presented by a split-crank pedaling device are beyond the physical capabilities of many stroke patients and thus rehabilitation efforts using such currently known devices are not effective as the patients either become frustrated and discouraged or practice improper movements, limiting rehabilitative effect.

Currently available split-crank bicycles can provide motor-controlled assistance and resistance torque to the cranks of the pedals. One example is described in Van der Loos, H. F. Machiel, "A Split-Crank, Servomotor-Controlled Bicycle Ergometer Design for Studies in Human Biomechnics." *IEEE/RSJ Int. Conference on Intelligent Robots and Systems EPFL* (October 2002), which is hereby incorporated by reference in its entirety. However, such split-crank bicycle is adapted as an ergometer for biomechanic investigation. The systems, operations, and controls are not adapted for treatment of patients through physical therapy, training, or rehabilitation. Therefore different solutions for these purposes are needed.

U.S. Pat. No. 6,234,939 discloses a unipedal cycle apparatus in which each of the right and left sides of a cycle have independent drive systems. The resistance on each drive system can be controlled independently by a microprocessor to increase or decrease the tension on a brake belt for the left and right drive systems. However, this is only related to variable resistance and does not provide assistive support.

U.S. Pat. No. 7,727,125 discloses an exercise machine and method for use in training selected muscle groups with resistance to split crank rotations. An inertia of the bike/rider system is simulated as would be experienced when riding a conventional bicycle by executing a stored training program with predetermined changes to crank resistance based upon crank position.

U.S. Pat. No. 8,602,943 discloses an exercise apparatus and a brake mechanism where a reciprocating activation means in response to a measured force exerted on the reciprocating activation means. The controller operates the system to provide assistance or resistance to a pedal stroke or a portion of a pedal stroke to maintain the system operation within a predefined cycle range.

BRIEF DISCLOSURE

Split-crank pedaling devices and methods of operation and use thereof are disclosed herein to support patient use and rehabilitation, particularly for stroke patients. Embodiments of such split-crank pedaling device use motors to provide a challenging yet tractable task for a patient to practice the strength and movement of the paretic limb and to practice coordinated movement between the paretic and non-paretic limbs.

The motor control is provided in a closed loop control to provide a driven assistance to improve the motor output of the lower limbs individually and to practice and improve inter-limb coordination.

An exemplary embodiment of a split-crank pedaling device includes first and second crank assemblies. Each crank assembly includes a pedal connected to a shaft by an arm. A first motor is operably connected to the first crank assembly. A first shaft sensor is arranged relative to the first crank assembly or the first motor. The first shaft sensor produces an indication of a position of the shaft of the first crank assembly. A second motor is operably connected to the second crank assembly. A second shaft sensor is arranged relative to the second crank assembly or the second motor. The second shaft sensor produces an indication of a position of the shaft of the second crank assembly. A controller is communicatively connected to the first and second motors and the first and second shaft sensors. The controller receives the data from the first and second shaft sensors. The controller calculates a phase error between the positions of the first and second shafts and a predetermined phase relationship between the first and second shafts. The controller operates at least one of the first motor or the second motor to provide a supplemental torque to one of the first crank assembly and the second crank assembly.

In exemplary embodiments, the shaft sensors may be position encoders or servo drives that produce feedback signals indicative of the positions of the first and second shafts. The device may include a proportional gain controller that receives the calculated phase error and applies a proportional gain constant to the calculated phase error to calculate the supplemental torque. The controller may operate the first motor and the second motor to provide the supplemental torque with the first motor if the calculated supplemental torque is negative and to provide the supplemental torque with the second motor if the calculated supplemental torque is positive. In an embodiment, the supplemental torque is provided in the direction of advancement of the first and second motors.

In further exemplary embodiments, a gravitational assist module is executed by the controller to receive the rotational positions of the first and second shafts. The gravitational assist module uses the respective rotational positions with a gravitational assist model to provide a gravitational supplement current to the first and second motors. The controller may execute a calibration of the gravitational assist model by controlling the motors to hold the first and second shafts at predetermined rotational positions and measuring the current used by the motors to hold the predetermined rotational positions. In a still further exemplary embodiment, a physiological sensor is configured to couple to a subject and communicatively connected to the controller and the controller adjusts operation of the motors based upon data collected from the physiological sensor.

An exemplary embodiment of a method of providing training support with a split-crank pedaling device includes producing indications of positions of shafts of crank assemblies. The indications of the positions of the shafts are received from first and second shaft sensors. A phase error between the positions of the shafts and a predetermined phase relationship between the first and second shafts is calculated. At least one of a first motor or a second motor are operated to provide a supplemental torque to one of the first crank assembly and the second crank assembly.

Exemplary embodiments of the method include performing the method with a split-crank pedaling device that includes first and second crank assemblies, each crank assembly comprising a pedal connected to a shaft by an arm, a first motor operably connected to the first crank assembly, a first shaft sensor arranged relative to the first crank assembly or the first motor to produce an indication of a position of the shaft of the first crank assembly, a second motor operably connected to the second crank assembly, a second shaft sensor arranged relative to the second crank assembly or the second motor to produce an indication of a position of the shaft of the second crank assembly, and a controller communicatively connected to the first and second motors and the first and second shaft sensors.

Further exemplary embodiments of the method further include providing a gravitational supplement current to the first and second motors based upon the received positions of the first and second shafts and a gravitational assist model. The gravitational supplement currents are positive or negative dependent upon the respective rotational positions of the first and second shafts. The gravitational assist model may be calibrated by controlling the motors to hold the shafts at predetermined rotational positions and measuring current used by the motors to hold the predetermined rotational positions. Multiple current measurements may be acquired at each of the predetermined rotational positions of the shafts. A gravitational supplement current for positions of the shafts may be calculated from the current measurements.

DETAILED DISCLOSURE

Figure 1:
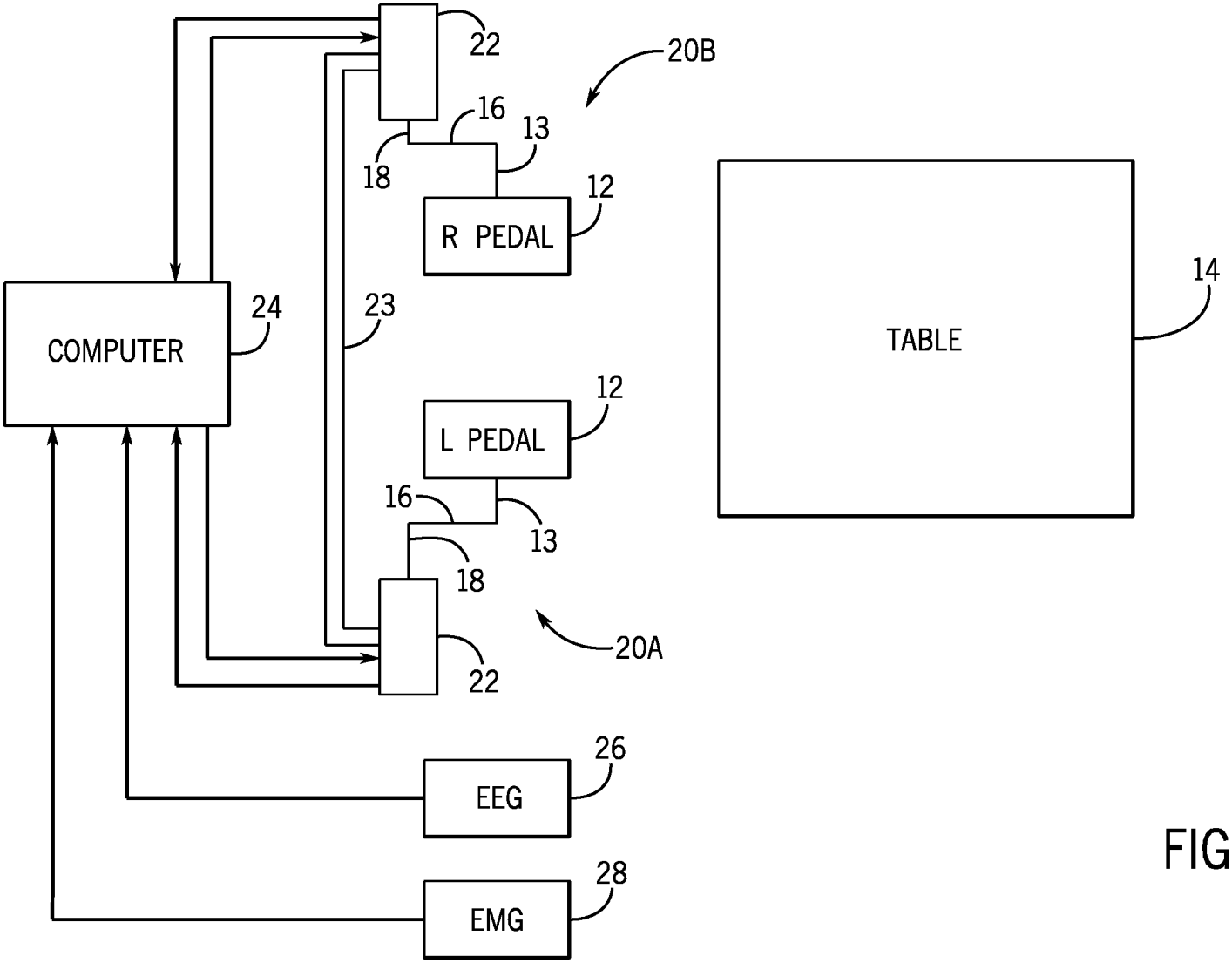
FIG. 1 is a system diagram of an exemplary embodiment of a split-crank pedaling device.

FIG. 1 is a system diagram of an exemplary embodiment of the split-crank pedaling device 10 as disclosed in further detail herein. The split-crank pedaling device 10 includes two pedals 12, each pedal is configured to be actuated by a patient, exemplarily by engagement of the pedals 12 with the feet of the patient. The patient is exemplarily supported in a position relative to the split-crank pedaling device 10 by resting on a support 14, for example a table, chair, or plinth. The position of this support can be moved relative to the split-crank pedaling device 10 to adapt the system to the size, anatomy, and/or physiology of the patient. In an exemplary embodiment, the patient's feet may be removably secured to the pedals 12, for example by straps or ties, or other known securements. This can help to maintain contact between the feet and the pedals 12, particularly for the paretic limb.

The split-crank pedaling device 10 includes two independently operable crank assemblies 20A and 20B. Each crank assembly 20A, 20B exemplarily includes a pedal 12, a spindle 13, an arm 16, and a shaft 18. In each crank assembly 20A, 20B the pedal 12 is connected by the spindle 13 to the arm 16. The spindle 13 enables the pedal to rotate relative to the arm 16 to accommodate the angle of the foot and leg as the patient pedals. Unlike a conventional pedaling device, the right and left arms 16 are not mechanically coupled to one another. Instead each arm 16 is connected to, and rotates with, a respective shaft 18. Without further intervention as described herein, any rotation of one crank assembly 20 is thus independent from rotation of the other crank assembly 20.

The crank assemblies 20A and 20B are each connected to respective motors 22. Specifically, the shafts 18 are movably connected to the motors 22 and transfer torque from the motors 22 to the respective crank assemblies 20A and 20B. The motors 22 are operated independently in the manners as disclosed herein. The motors 22 may include a gear box or other mechanical coupling to the shaft, and may be any of a variety of known motors, although it will be recognized that in one embodiment the motors are servo motors, although it will be recognized by a person of ordinary skill in the art that other forms of motors may be used in other embodiments, including but not limited to stepper, torque, or dc motors. The motors 22 are connected to a controller 24 which includes a computer, processor, or microcontroller and exemplarily includes computer memory upon which drivers and/or external software is stored that is executed by the controller 24 to operate the motors 22 in the manners as disclosed herein. In an exemplary embodiment, the two crank assemblies 20A and 20B are secured to a frame 23, to which the motors 22 may be mounted. In an embodiment, the frame 23 defines the positional relationship between the crank assemblies 20A and 20B.

Figure 2:
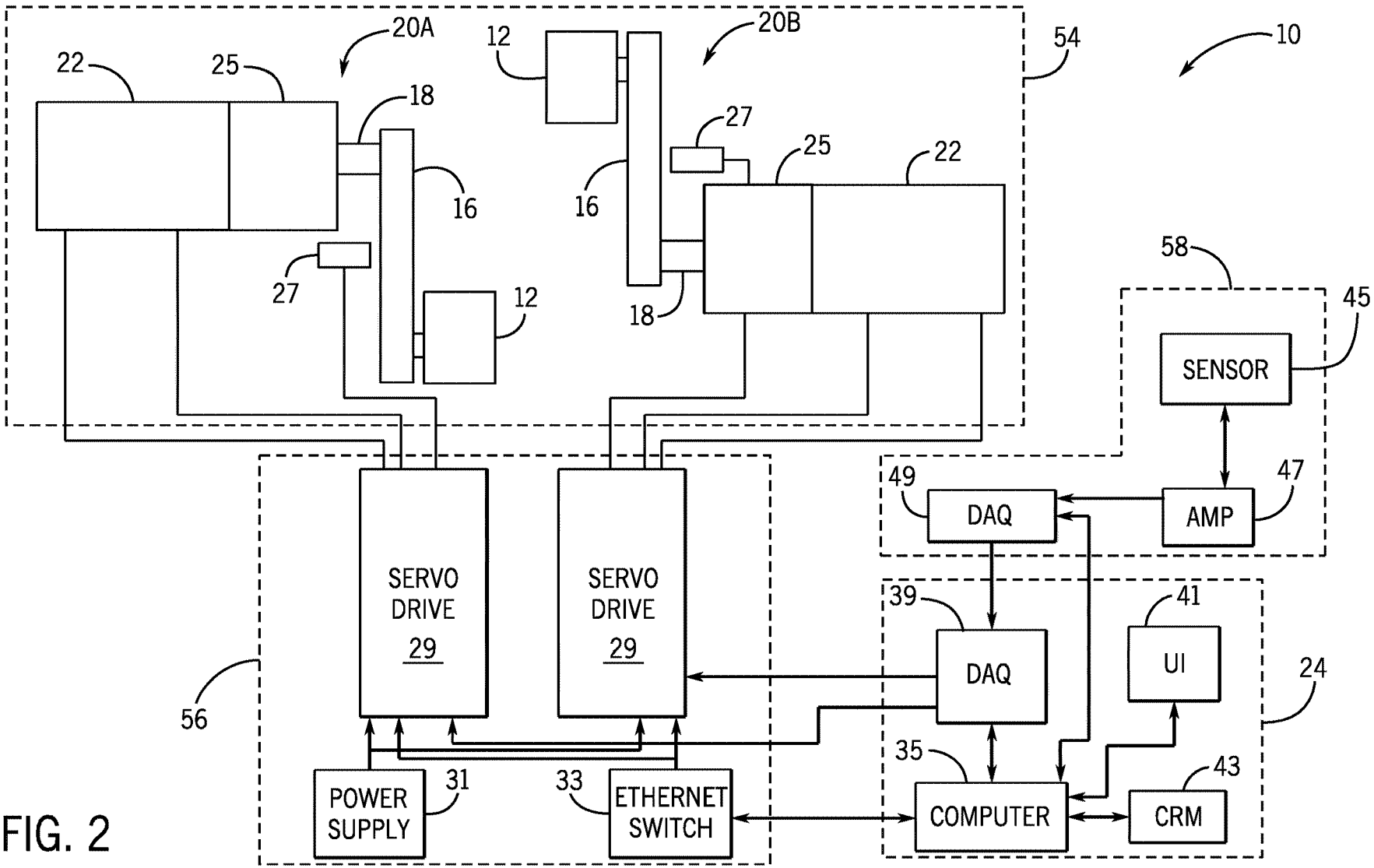
FIG. 2 is a system diagram of the electrical and electromechanical portions of an exemplary embodiment of the split-crank pedaling device.

FIG. 2 is a system diagram that depicts the electrical and electro-mechanical portions of an exemplary embodiment of the split-crank pedaling device 10. The system diagram exemplarily includes four sub-systems. A motor system 54 interfaces with the user through independently driven pedals 12. A controller 24 provides the operational computations and command signals to carry out the functions of the system described herein, including that of the motor system 54. An electronics system 56 provides the power and communicative connections between the controller 24 and the motor system 54. A biopotential system 58 acquires physiological feedback from the user to the controller 24. While these systems are described as separate systems grouped by functionality, it will be recognized that in other embodiments, the components of these system or entire systems themselves may be incorporated into other systems as have been described. In still further embodiments, the components of the systems may be integral with the components of some or all of the other systems, or the systems may be physically separate and only communicatively connected.

As described above, the motor system 54 includes two separate motors 22. The motors 22 may be AC synchronous servo motors and each are connected to a respective crank assembly 20A, 20B by a gearbox 25. The gearbox 25 is exemplarily a 20:1 gearbox which amplifies the torque potential of the crank arms 16 with minimal addition to the system inertia. In exemplary embodiments, the crank assemblies 20A, 20B, the gearbox 25 and the servomotor 22 provide minimal system inertia (e.g. 3.4 N is needed to overcome system inertial effects). An inductive proximity sensor 27 is used to set the zero position of the respective motors 22. The motors 22 and associated proximity sensor 27 are communicatively connected to respective servo drives 29 in the electronics system 58.

The servo drives 29 operate as instructed from the control system to control and deliver power to the motors 22. Each servo drive 29 sends and receives communication over both analog and Modbus TCP protocol. A power supply 31 is used to receive e.g. electrical mains power and provide power to the servo drives 29 and the motors 22. An Ethernet switch 33 serves as a communication hub between the servo drives 29 and the computer 35 of the controller 24.

The controller 24 exemplarily includes a computer 35 and a data acquisition unit (DAQ) 39. The controller 24 further includes a user input device 41 to enable user inputs into the controller 24, for example the desired phase angle between the crank assemblies. The torque generated by each motor 22 is controlled by an analog signal from the DAQ 39. The servo drives 29 receive torque commands from the controller 24. Each servo drive 29 returns a position feedback signal to the controller 24. While in the embodiment depicted, the servo drive 29 operates as a shaft position sensor by returning a signal indicative of shaft position to the controller 24, it will be recognized that in other embodiments, other forms of sensors, including magnetic or optical or other dedicated shaft position sensors may be used to provide the position feedback signal to the controller 24. As will be discussed in further detail herein, since there is no mechanical connection between the right and left pedals, the controller 24 continuously monitors the relative position between the right and left pedals. The controller 24 also includes a computer readable medium 43 upon which control software in the form of computer readable code is stored. The computer 35 executes the computer readable code of the control software and carries out the calculations and functions as described in further detail herein.

The biopotential system 58 includes biopotential sensors 45, which may include EMG or EEG. Other biopotentials or physiological measurement values. The biopotential system 58 further includes an amplifier 47 and DAQ 49 to acquire the biopotential measurements and provide the biopotential data to the controller 24.

In an exemplary use, the patient is instructed to pedal forward while attempting to maintain the 180° out-of-phase relationship between the pedals as would be physically maintained in a conventional pedaling device with the crank arms mechanically connected by a single shaft. Successful completion of this attempted task of maintaining the 180° out-of-phase relationship between the pedals of the two separate crank assemblies 20A and 20B requires both strength by each limb independently and coordination between the two limbs. While the patient attempts to pedal the device, sensors, which may be associated or integral to the motors 22 measure the position, velocity, and/or acceleration of the cranks 16 about the axis of the shafts 18. It will be recognized that in other embodiments one or more of position, velocity, and acceleration may be derived from one or more values measured by sensors from the motors 22 or shafts 18. In one embodiment, the sensors may include, but are not limited to position encoders, and velocity and acceleration about the shaft is derived from the encoded position over time. In a non-limiting example, TD 5207 fiber optic encoders available from Micronor may be used to measure crank position and pedaling rate with a resolution of 0.025°. Torque may be measured for example using strain gauges with a sensitivity of 0.44 Ω/m (e.g. MFLA-5-350-11-1LJAY available from Tokyo Sokki Kenkyujo Co., Ltd.) mounted on the crank arms. It will be recognized that other types of sensors, including but not limited to, potentiometers may be used in other embodiments as well.

These data are provided to the computer 24 and provide indirect measures of the movements of the two limbs. As will be described in further detail herein, the measured data are used to provide commands to the motors to correct errors in pedal position by automatedly supplementing the patient's efforts to maintain the 180° out-of-phase relationship between the pedals. As will be disclosed in further detail, calculation of the error and the provided supplemental support may be provided in numerous ways and further may be adjusted in one or more ways to tailor the assistance to the physiological needs of the patient. In this manner, the actual experience of the patient can be tailored to be a task which is both challenging and tractable.

The supplemental support can be corrective in that it is provided in a direction to assist the patient to maintain the predetermined phase relationship. Alternatively the supplemental support can be resistive in a manner that that uses the phase feedback to increase the resistance to the predetermined phase relationship. In still further exemplary embodiments, the supplemental support can augment the error in the phase relationship. The type of error upon which supplemental support is provided may be adjusted. In some embodiments, any detected error may be responded to with motor assistance while in other embodiments, a "dead zone" of error can be established and/or adjusted so that only when error greater than a predetermined amount or threshold is detected, is supplemental support provided. Additionally, the strength/speed of the correction can be adjusted to be provided gradually or suddenly. In an embodiment, this can be controlled through adjustment of a proportional gain constant. In other embodiments, a dynamic gain can be used and further may include integral and/or derivative gains. With these adjustments, the motors can be operated in a manner such that all or a majority of the work is provided by the motors and no errors in the phase relationship between the pedals are experienced. In another embodiment, the phase relation between the pedals can be adjusted. For example, the target phase relationship between the pedals may be an angle different than 180°, instead the target phase relationship may exemplarily be +/−150° or 0° or any other angle. In still further embodiments, the trajectory of the limbs (pedals) can be perturbed to intentionally create externally generated errors. In other embodiments, the motors may be operated to increase pedaling resistance, for example to simulate sources of pedaling resistance, for example hills, wind, sand, and gear changes. As noted above, in embodiments, the supplemental support may increase the resistance to the pedal in a manner that magnifies with increases in phase error. These modifications can provide even further challenge to a patient nearing recovery or for extra-normal recovery, or physical training for example for rehabilitation of athletes from injuries or surgery.

Figure 3:
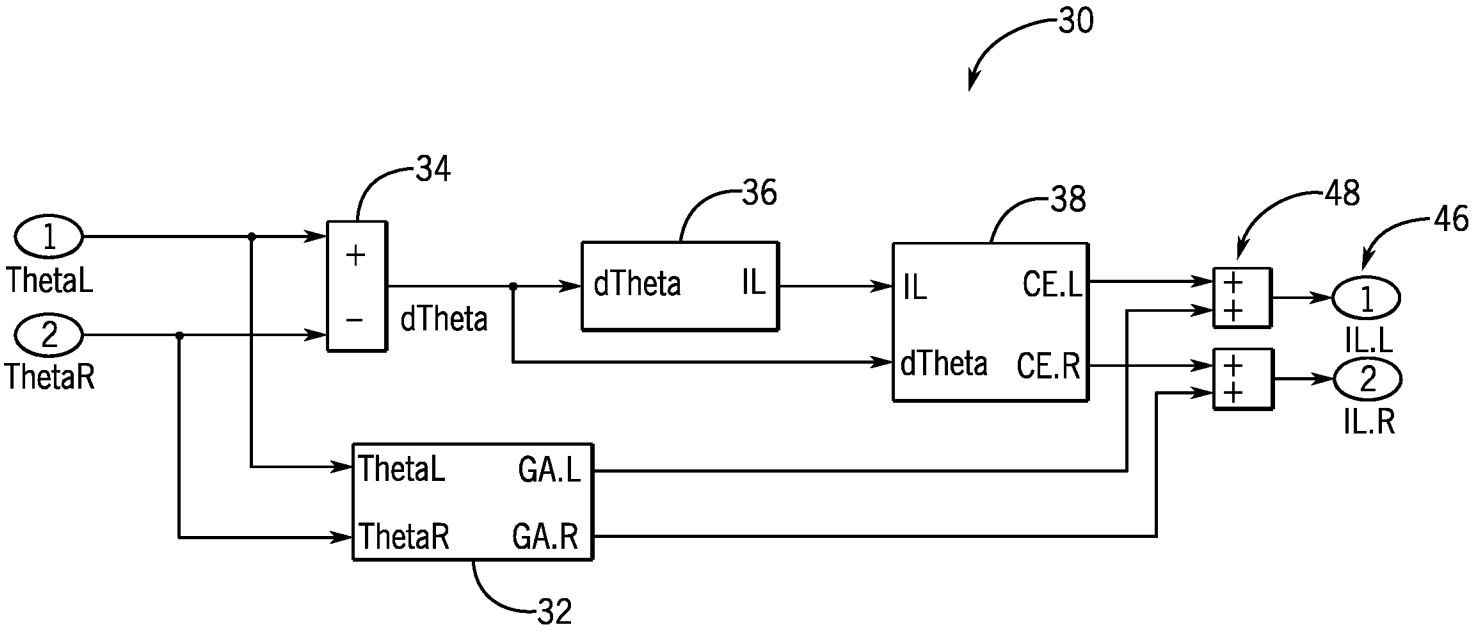
FIG. 3 is schematic diagram of exemplary controls for a split-crank pedaling device.

FIG. 3 is a schematic diagram of the controls executed by the controller 24 to operate the motors 22 in accordance with the present disclosure. As previously noted, the controller 24 receives data, from sensors which for example may be either integral with the motors (e.g. from encoders integral with the motors 22 or from sensors elsewhere associated with the motors 22 and/or shafts 18 of the crank assemblies 20A, 20B. As previously described the servo drives 29 may provide feedback indicative of the shaft position of each of the crank assemblies 20A, 20B. The received data provide shaft position, and may further provide velocity and acceleration of the same. In an exemplary embodiment, the shaft position may be represented as an angle of rotation or an angular position within a revolution of the shaft. These current positions are characterized at the controller 24 as ThetaL and ThetaR, as depicted in FIG. 3. The ThetaL and ThetaR values are provided to a gravitational assist module 32. The gravitational assist module 32 will be described in further detail, but provides compensation to account for the contralateral limb recovery during conventional pedaling that is otherwise not available in split-crank pedaling due to the lack of mechanical connection between the crank assemblies.

A proportional gain controller 36 is used to provide the supplemental support. The position of each motor is read from the servo drives 29. When the desired (e.g. input) phase relationship between the crank assemblies is not maintained, the controller 24 operates the motors 22 to provide a supplemental torque to restore the phase relationship. The proportional gain controller 36 operates to provide a continuous linear response that increases with error and allows minimal torque for error correction. The proportional gain constant is not fixed across subjects, nor does it need to be fixed within/across the experimental runs of a given subject. The proportional gain constant may be selected for each subject based upon balancing two measured responses of the subject such that the pedaling task can be sustained over time (e.g. to avoid exhausting mental frustration) and therefore seeking to maximize a subject's contribution to the task as measured through one or more physiological signals, for example EMG signals. As previously noted, the proportional gain controller 36 may alternatively provide supplemental torque that resists pedaling in one or both of the crank assemblies as phase error increases. The proportional gain controller 36 can also perform error augmentation to change the phase relationship based upon the phase error. In this manner, the system becomes easier for the patient to pedal when the desired/predetermined phase relationship between the crank assemblies is maintained.

The difference between the ThetaL and ThetaR values is calculated at 34. This produces the difference between the two Theta values, represented as the value dTheta. As previously noted, in the exemplary use embodiment, ThetaL and ThetaR are expected to be 180° out-of-phase, or an equivalent motor control numerical value. In an exemplary embodiment, the calculation of dTheta may use modular arithmetic to enable the equality of 0° and 360° in the calculations. The dTheta value is provided to a proportional controller 36. Furthermore, since the dTheta value represents the current relative positions of the crank assemblies, dTheta is also provided to the correction distribution module 38, as will be described in further detail herein.

Figure 4:
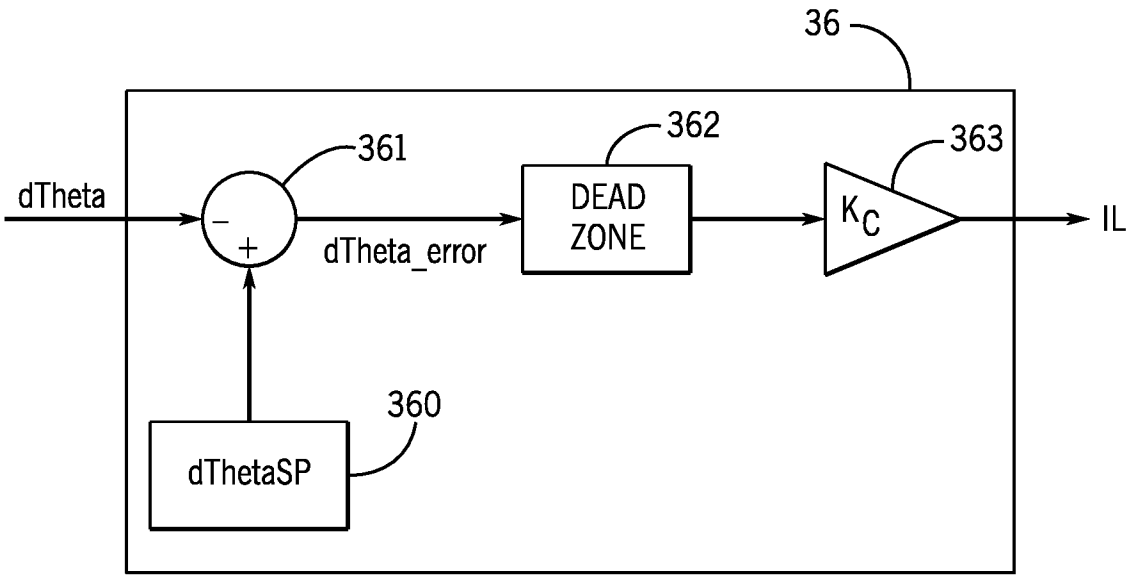
FIG. 4 is a schematic diagram of an exemplary embodiment of a proportional controller for spilt-crank pedaling device.

FIG. 4 is a schematic diagram of exemplary calculations performed by the proportional controller 36. Proportional gain controller 36 exemplarily accesses a predetermined target phase difference (dTheta_sp) between the crank systems 20A and 20B. In accordance with the exemplary embodiment described herein, dTheta_sp exemplarily equals 180. In exemplary embodiments, the dTheta_sp value 360 may be previously input by a clinician during a set up procedure before the split-crank pedaling device is used with a patient. This value may be input via a user interface to the controller and may exemplarily be input as a numerical value or may be selected from a drop-down menu or other selection graphical user interface (GUI). The proportional controller 36 further receives the dTheta value as calculated at 34 from the measured positions of the respective crank systems 20A, 20B.

A difference between the stored dTheta_sp value 360 and the calculated dTheta value is calculated at 361 to produce a dTheta_error value. The dTheta_error is thus representative of the angular error between the target phase difference between the crank systems and the actual phase difference between the crank systems.

The dTheta_error value is exemplarily provided to a dead zone comparator 362. In an exemplary embodiment, a dead zone may be used which predefines a tolerable amount of error in the phase relation between the pedals. While a dead zone of zero will result in an intervention for any amount of error, a non-zero amount of dead zone creates a threshold of required error for an intervention. This can provide subjects with a smoother and continuous pedaling experience with fewer intervention events. This is exemplarily described by Wolbrecht in 2008. If the dTheta_error is greater than the predetermined error dead zone value, then the dTheta_error is provided to an amplifier 363 to provide amplification of the output current by a gain that is proportional to the dTheta_error value. In this manner, the error correction current (IL) is proportional to the size of the present error in the phase difference between the crank assemblies 20.

Returning to FIG. 3, the proportional controller provides an output of IL to the correction distribution module 38. The correction distribution module functions to direct the additional corrective input current to the motor associated with the crank assembly in need of corrective support. In an exemplary embodiment, the system may operate upon a heuristic to provide corrective support in the direction that the crank assemblies are being moved. In this sense, the system corrects itself by helping to accelerate the lagging limb until the limbs are back into the target phase difference. However, it will be recognized that in other embodiments, other correction strategies may be employed. The corrective support may be split evenly or unevenly between the crank assemblies. In another embodiment, the corrective support may be to resist movement of the leading limb. Due to the proportional controller described above which provides the corrective support (IL) as the input to the correction distribution module 38, as the phase error between the crank systems becomes less, the corrective support (IL) also diminishes. Therefore, in this system, the patient can experience a smooth increase (and decrease) in corrective support during use of the device.

The correction distribution module operates to distribute the correction across both legs. Since stroke survivors experience motor control impairment across both legs, or to leg function in coordination, it is inadequate to only provide correction to just a single leg. The modular arithmetic of the proportional gain controller enables the determination of which leg is leading and which leg is lagging. In an exemplary embodiment, the correction distribution is determined based upon the sign of dTheta. Exemplarily, if dTheta is positive, the right leg receives the correction torque. If dTheta is negative, the left leg receives the correction torque. The correction torque is provided in the direction of advancement to assist the lagging leg. It will be recognized that the disclosed system can also enable other distribution strategies, for example distribution as a function of error, position, velocity, time, or muscle activity.

Figure 5A:
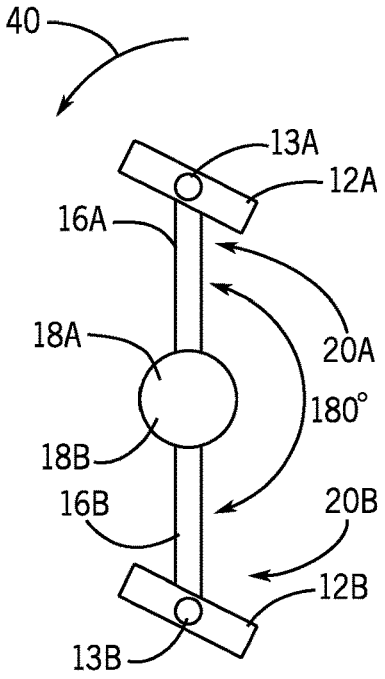
FIG. 5A-5C diagrammatically depict an exemplary embodiment of correction distribution between crank assemblies.
Figure 5B:
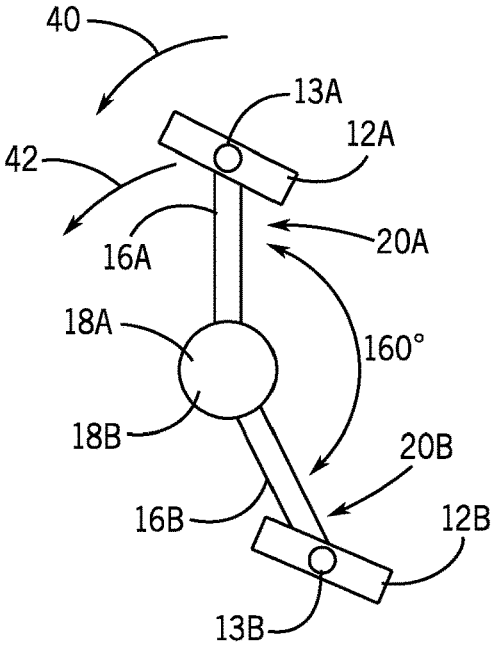
Figure 5C:
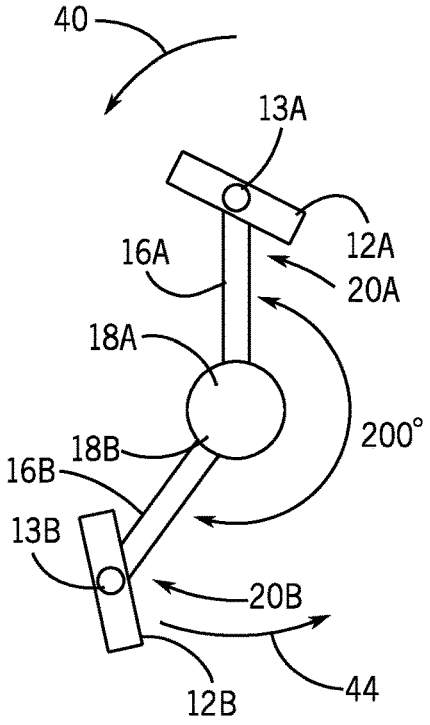

FIGS. 5A-5C diagrammatically depict an exemplary embodiment of the correction distribution between crank systems 20A, 20B. It will be noted that the crank systems 20A and 20B are depicted in axial alignment as they would be exemplarily viewed directly from the right or left side; although it will be recognized that the crank systems 20A and 20B are physically independent as described above. In FIG. 5A, the crank systems 20A and 20B are being pedaled in the direction of arrow 40. The crank assemblies 20A and 20B are 180° out-of-phase and therefore the dTheta_error as calculated in the proportional controller 36 will be zero (as 180° out-of-phase is the exemplary target phase difference) and corrective support (IL) calculated by the proportional controller 36 is also zero. As will be recognized, if a "dead zone" correction strategy is employed, for a predefined amount of dTheta_error between the crank systems 20A and 20B, no corrective support would also be provided until dTheta_error was outside of the predetermined error threshold. In embodiments, an angular coordinate system must be defined to determine if dTheta_error is positive or negative. Modular arithmetic is needed to use the sign of dTheta_error to determine which leg (crank system) is leading or lagging.

In FIG. 5B, crank assemblies 20A and 20B are similarly pedaled in the direction of arrow 40. In FIG. 5B, the crank assemblies 20A and 20B are now determined to be 160° out-of-phase, or crank assembly 20A is lagging in its target location relative to crank system 20B. In this case, the dTheta_error value will exemplarily be positive 20° or a motor control numerical equivalent. Crank assembly 20A will thus be considered to be "lagging" the position of crank assembly 20B, as crank assembly 20A needs to accelerate in the direction of the pedaling 40 to achieve the desired 180° out-of-phase relationship. As dTheta_error is a non-zero value (and for the purposes of the example is assumed to be greater than any predetermined "dead zone" error value), the proportional controller 36 calculates a non-zero corrective support (IL). The correction distribution module 38, upon receiving the dTheta value, may also determine that the crank assembly 20A is the "lagging" system and thus directs the corrective support to crank assembly 20A, the result of which is represented by arrow 42. Due to the proportional nature of the corrective support provided by the proportional controller 36, the corrective support 42 provided to the crank assembly 20A diminishes as the dTheta value approaches the desired phase relationship between the crank systems 20 (i.e. as the dTheta_error value approaches zero)

In FIG. 5C, crank assembly 20A and 20B are similarly pedaled in the direction of arrow 40. In FIG. 5C, the crank assembly 20A and 20B are now determined to be 200° out-of-phase, or crank assembly 20B is lagging in its target location relative to crank assembly 20A. In this case, the dTheta_error value will exemplarily be negative 20° or a motor control numerical equivalent. Crank assembly 20B will thus be considered to be "lagging" the position of crank assembly 20A, as crank assembly 20B needs to accelerate in the direction of the pedaling 40 to achieve the desired 180° out-of-phase relationship. As dTheta_error is a non-zero value (and for the purposes of the example is assumed to be greater than any predetermined "dead zone" error value), the proportional controller 36 calculates a non-zero corrective support (IL). The correction distribution module 38, upon receiving the dTheta value, may also determine that the crank system 20B is the "lagging" system and thus directs the corrective support to crank assembly 20B, the result of which is represented by arrow 44 which similarly points in the direction of the pedaling 40. Due to the proportional nature of the corrective support provided by the proportional controller 36, the corrective support 44 provided to the crank assembly 20B diminishes as the dTheta value approaches the desired phase relationship between the crank systems 20 (i.e. as the dTheta_error value approaches zero)

It will be recognized that determinations regarding "leading" or "lagging" crank assembly are referential in nature. Therefore, while the phase measurement between the crank assembly 20A and 20B is described herein based upon the referential angle between the assembly exemplarily proximal to the patient, it will be recognized that other embodiments may use the referential angle between the crank assembly 20A and 20B that is distal from the patient. In a still further exemplary embodiment, the system may use a master-slave arrangement, where one of the crank assembly 20 is specified as the dominant assembly (for example, but not limited to a crank assembly 20 associated with the non-paretic limb) and the correction is consistently applied to the other crank assembly 20 (for example, the crank assembly 20 associated with the paretic limb). In still further exemplary embodiments, the supplemental support may be divided between the crank assemblies, for example to reduce the torque output of the motor of the leading limb while increasing the torque output of motor of the lagging limb. Such an embodiment may exemplarily be used in combination with the gravitational assist as described in further detail herein.

Returning back to FIG. 3, in one simplified version of the system 30, the corrective support IL once distributed to the appropriate crank assembly 20, is output as a motor current IL.L or IL.R at 46 to the corresponding motor 22A, 22B. However, as noted above, pedaling a conventional pedaling device with the crank arms mechanically connected by a single shaft provides contralateral limb recovery as force (e.g. down or in the direction with gravity) against one pedal pushes the other pedal (independent of user input force)

against gravity. Splitting the crank into separate crank assemblies 20A and 20B eliminates this mechanical recovery. In one embodiment, the lack of this contralateral limb recovery support may reflect itself in observed changes in dTheta_error, and result in greater corrective support IL provided to one or the other of the crank assemblies 20A and 20B. In an example, without the contralateral limb recovery, one would expect the "recovering" limb to lag the force limb, resulting in a corrective support to the "recovering" limb.

Figure 6A:
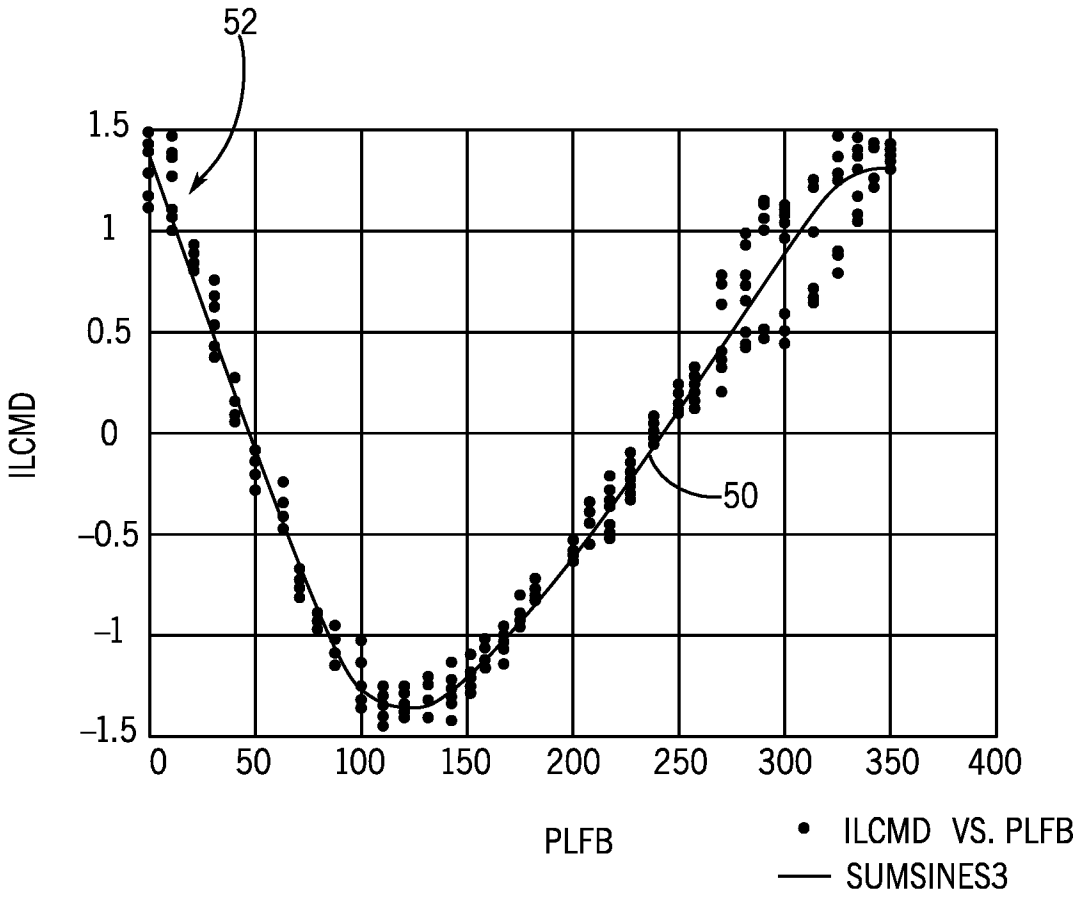
FIGS. 6A and 6B exemplarily depict gravitational assist curves.
Figure 6B:
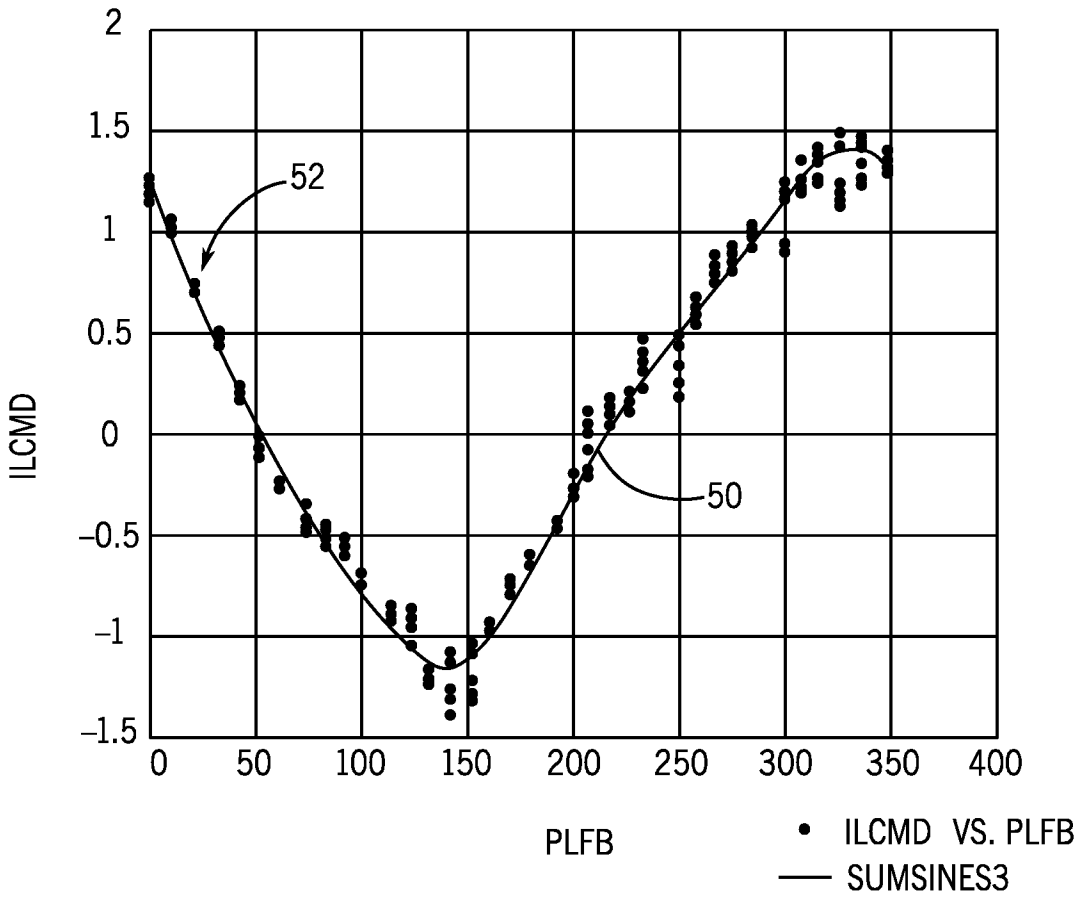

However, another solution is proposed herein to address this problem. As depicted in the system 30, a gravitational assist module 32 receives the inputs of the ThetaL and ThetaR values as obtained from the crank assemblies 20A and 20B. The gravitational assist module 32 is executed by the controller 24 to provide supplemental torque output from the motors 22. The gravitational assist module 32 uses the ThetaL and ThetaR values to calculate a baseline gravitational assist input current (e.g. GA.L and GA.R) provided to each of the motors 22 to simulate the contralateral limb recovery of conventional cycling. FIGS. 6A and 6B are graphs which exemplarily represent the gravitational assist input current over a positional cycle of a right crank assembly (FIG. 6A) and a left crank assembly (FIG. 6B) represented with an x-axis which presents rotation of the respective crank systems wherein 0 represents a vertical and upwardly oriented crank and 180 represents a vertical and downwardly oriented crank. The gravitational assist current is exemplarily positive when the motor works to drive the crank assembly in the direction of pedaling while negative values indicate where the current to the motor opposes movement in the direction of pedaling. Just as the gravitational assist is provided as a positive value when the crank assembly is moving against gravity, the gravitational assist is provided as a negative value when the pedal is moving in the same direction as gravity. This is in part to counteract the additional help from gravity, but also to simulate the resistance to movement experienced during pedaling of a conventional pedaling device with the crank arms mechanically connected by a single shaft as the opposite pedal is recovered. This is exemplarily depicted in the solid lines presented in the graphs of FIGS. 6A and 6B.

With reference to FIGS. 6A and 6B, the gravitational assist current curves 50 depicted therein may be provided in a variety of manners. FIGS. 6A and 6B give an example of a model used to calculate the gravitational supplement current. The model may be static and fixed or may be dynamic and adjusted based upon inputs from the subject's interaction with the device 10. In one exemplary embodiment, one or more standardized or general curves may be used. When multiple curves are available for use, such curves may be characterized by patient demographics or generalized anatomical and physiological traits, including but not limited to height, weight, age, gender.

It has been recognized that other embodiments may benefit from gravitational assist curves calculated for each individual patient. In such embodiments, a calibration procedure may be performed to collect data particular to an individual patient, and the gravitational assist curve 50 fit to the collected patient calibration data. In exemplary embodiments, it has been found that limb flexibility, limb length, limb weight and position of the patient's body relative to the crank systems can each have influence on the gravitational assist curve 50 for that patient and that limb. Depending upon a patient's particular physiological response to stroke, the paretic limb may become either stiff or pliable, similarly the paretic limb may atrophy and weigh less than expected or may gain weight as the patient is unable to maintain exercise and gains weight overall. Therefore, individual patient responses may make generalized gravitational assist curves 50 inaccurate or unrepresentative of the patient's actual experience. Accordingly, the calibration procedure does not require the subject to have adequate motor control to perform either bilateral or unilateral pedaling.

In an exemplary embodiment, one calibration procedure may involve a controlled routine of operation of the crank systems 20 with the patient's limbs secured to the pedals 12. The motors 22 operate the crank systems 20 to make a full revolution in increments. Exemplarily, but not limiting, these increments may be 10° increments. The motors 22 are instructed to hold the predefined angle increments and a measurement is taken of the input current necessary to maintain the instructed predefined angle increments. In one example, a measurement is taken once every 0.2 seconds for a total of ten measurements at each angle increment over two seconds at each increment. In an alternative embodiment, the crank systems 20 may be operated to move in a continuous, but slow manner through one or more rotation cycles. In such an embodiment measurements may be taken at a series of sequential angle increments over one or more rotation cycles. In a non-limiting example of a continuous movement calibration process, a measurement is taken at each degree of rotation and the crank systems 20 operated to continuously rotate at a slow pace, for example at 0.2 seconds per degree. It will be recognized that faster or slower rotations or data collection over multiple rotations may be used to collect data for the calibration. The input current necessary to perform the continuous rotation process can be measured as the calibration data. The data points 52 depicted in FIGS. 6A and 6B exemplarily represent measurements over the course of a calibration procedure. The gravitational assist curve 50 is then exemplarily obtained using any of a variety of known curve-fitting techniques based upon the collected data. In an exemplary embodiment, a sum of sines technique is used to curve-fit the gravitational assist curve 50 to the collected data. Subjects with stroke do not exhibit normal bilateral or normal unilateral pedaling with either leg. Therefore, with the above gravitational assist calibration procedure, the subject can be in a relaxed state and allow movement of either or both limbs by the system. In this manner, the system could even calibrate for a completely paralyzed limb enabling use of the device by an acute stroke survivor.

As depicted in FIG. 3, summation modules 48, combine the gravitational assist input currents (GA.L and GA.R) with the respective distributed correction currents (CE.L and CE.R). The combination of these two motor input currents for each of the motors 22, are respectively output as the operating currents 46 to the motors 22. The system 30 operates for the duration of the patient use of the system to provide closed-loop feedback control of the motors 22 to provide adaptive pedaling support to the user operating the split-crank pedaling device.

Exemplary embodiments of the split-crank pedaling device as disclosed herein and as exemplarily depicted in FIG. 1 may be used in a variety of manners in order to treat patients to provide stroke rehabilitation. Other patients with neurological impairment may potentially benefit from use of the disclosed split-crank pedaling device, for example, but not limited to patients with spinal cord injury, cerebral palsy, multiple sclerosis (MS). Persons of ordinary skill in the art will also recognize that embodiments as disclosed herein may also be used for rehabilitation of other aliments, including, but not limited to injury or surgery rehabilitation, and may also be used in performance training. The adjustability of the corrected input strength and duration, as well as adjustment of an error dead zone enable the mechanical support provided to the patient to be adjusted over time as the patient recovers to maintain the operation in a challenging but tractable condition which fosters patient motivation and compliance. In exemplary embodiments of the split-crank training cycle, the patient may be permitted to perform sustained periods of pedaling with or without equal contribution between the paretic and non-paretic legs. The device may permit and promote reciprocal, multi-joint flexion and extension of both lower limbs including a paretic and non-paretic limb. In this respect, pedaling rehabilitation activities share important features with walking, for example as walking also involves bilateral, continuous, reciprocal leg movement.

The split-crank pedaling device 10 as disclosed herein along with the controls thereof provide improved physical therapy support to subjects with a paretic leg, for example stroke survivors. However, stroke survivors and other subjects often present impairment to the function of both legs to varying degree. The paretic limb is more affected by the stroke, but the non-paretic limb is also affected, although frequently in a lesser and different extent. Subjects also exhibit coordination problems wherein each leg works better separately than when the legs are worked together. The inventors have discovered that there is no a priori assumption that one leg should be a master and the other leg a slave for the purposes of assistance as either can lag in performance at any time or place in the pedaling cycle, requiring the corrective torque.

The split-crank pedaling device 10 supports the physical training of subjects with stroke. While the coordination errors noted above can occur in either leg, a subject with stroke will tend to resist use of the paretic limb. Physical training seeks to encourage training by maximizing the use of the paretic limb and achieving prolonged periods of use. Operation of the pedals by the subject to produce smooth, forward crank progression promotes physical therapy goals. In embodiments, keeping the proportional gain constant to a minimum meets these therapeutic objectives. A proportional corrective torque is important to encourage subject physical therapy as the training adapts to the use to provide more torque as a pedal lags further behind and less (or no corrective) torque as the phase relationship is maintained. As noted above, the correction is provided to the lagging leg. The independence of the right and left crank systems with an independence of the system to receive the corrective torque provides a system with which a subject can train to address inter-limb coordination, particularly with at least one paretic limb.

As depicted in FIG. 1, embodiment of the split-crank pedaling device 10 may be incorporated with external physiological monitors of the patient condition, for example, but not limited to electroencephalography (EEG) 26 or electromyography (EMG) 28. For example, EEG, and particularly with electrical or magnetic brain stimulation permits examination of cortical activation of the patient's brain. This may produce further feedback information to the controller 24 whereby the training procedure may be adjusted inter-procedure or intra-procedure in response. EMG electrodes may be connected to the legs of the patient to measure muscular activity and engagement during the therapy session. Feedback from the EMG data may be provided to the controller 24 and used to adjust the parameters of the operation of the split-crank pedaling device intra-procedure or inter-procedure. For example, if a patient improves operation of the split-crank pedaling device and gains strength and coordination in the lower limbs this may be reflected in the EMG measurements, providing an indication that less mechanical assistance should be provided to one or both legs or that an increased dead zone in the error correction should be introduced.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A split-crank pedaling device, comprising:

first and second crank assemblies, each crank assembly comprising a pedal connected to a shaft by an arm;

a first motor operably connected to the first crank assembly;

a first shaft sensor arranged relative to the first crank assembly or the first motor to produce an indication of a position of the shaft of the first crank assembly;

a second motor operably connected to the second crank assembly;

a second shaft sensor arranged relative to the second crank assembly or the second motor to produce an indication of a position of the shaft of the second crank assembly; and a controller communicatively connected to the first and second motors and the first and second shaft sensors, the controller receives the indications of the positions of the first and second shafts from the first and second shaft sensors, calculates a phase error between the positions of the first and second shafts and a predetermined phase relationship between the first and second shafts, and operates at least one of the first motor or the second motor to provide a supplemental torque to one of the first crank assembly and the second crank assembly.

2. The split-crank pedaling device of claim 1, wherein the first shaft sensor and the second shaft sensor are position encoders associated with the respective first and second motors.

3. The split-crank pedaling device of claim 1, wherein the first shaft sensor and the second shaft sensor are first and second servo drives that produce feedback signals indicative of the positions of the first shaft and the second shaft.

4. The split-crank pedaling device of claim 1, wherein the first shaft sensor and the second shaft sensor provides at least one of shaft position, shaft acceleration, and shaft velocity data.

5. The split-crank pedaling device of claim 1, further comprising a proportional gain controller that receives the calculated phase error and applies a proportional gain constant to the calculated phase error to calculate the supplemental torque.

6. The split-crank pedaling device of claim 5, wherein the controller operates the first motor and the second motor to provide the supplemental torque with the first motor if the calculated supplemental torque is negative and to provide the supplemental torque with the second motor if the calculated supplemental torque is positive.

7. The split-crank pedaling device of claim 6, wherein the supplemental torque is provided in the direction of advancement of the first and second motors.

8. The split-crank pedaling device of claim 1, wherein the controller calculates the phase error as a phase error greater than a dwell error threshold.

9. The split-crank pedaling device of claim 1 further comprising a gravitational assist module executed by the controller to receive the rotational positions of the first and second shafts, and using the respective rotational positions with a gravitational assist model, provides a gravitational supplement current to the first and second motors.

10. The split-crank pedaling device of claim 9, wherein the gravitational supplement currents are positive or negative dependent upon the respective rotational positions of the first and second shafts.

11. The split-crank pedaling device of claim 9, wherein the controller executes a calibration of the gravitational assist model by controlling the motors to hold the first and second shafts at predetermined rotational positions and measuring the current used by the motors to hold the predetermined rotational positions.

12. The split-crank pedaling device of claim 1, further comprising a physiological sensor configured to couple to a subject and communicatively connected to the controller, wherein the controller adjusts operation of the motors based upon data collected from the physiological sensor.

13. A method of providing training support with a split-crank pedaling device comprising first and second crank assemblies, each crank assembly comprising a pedal connected to a shaft by an arm, a first motor operably connected to the first crank assembly, a first shaft sensor arranged relative to the first crank assembly or the first motor to produce an indication of a position of the shaft of the first crank assembly, a second motor operably connected to the second crank assembly, a second shaft sensor arranged relative to the second crank assembly or the second motor to produce an indication of a position of the shaft of the second crank assembly, and a controller communicatively connected to the first and second motors and the first and second shaft sensors, the method comprising:

receiving the indications of the positions of the shafts from the first and second shaft sensors;

calculating a phase error between the positions of the shafts and a predetermined phase relationship between the first and second shafts; and operating at least one of the first motor or the second motor to provide a supplemental torque to one of the first crank assembly and the second crank assembly.

14. The method of claim 13, wherein the first shaft sensor and the second shaft sensor are first and second servo drives that produce feedback signals indicative of the positions of the first shaft and the second shaft.

15. The method of claim 13, further comprising calculating the supplemental torque by applying a proportional gain constant to the calculated phase error.

16. The method of claim 15, further comprising determining to provide the supplemental torque with the first motor if the calculated supplemental torque is negative and to provide the supplemental torque with the second motor if the calculated supplemental torque is positive.

17. The method of claim 16, wherein the supplemental torque is provided in the direction of advancement of the first and second motors.

18. The method of claim 13, further comprising providing a gravitational supplement current to the first and second motors based upon the received positions of the first and second shafts and a gravitational assist model wherein the gravitational supplement currents are positive or negative dependent upon the respective rotational positions of the first and second shafts.

19. The method of claim 18, further comprising calibrating the gravitational assist model by:

controlling the motors to hold the shafts at predetermined rotational positions; and measuring current used by the motors to hold the predetermined rotational positions.

20. The method of claim 19, wherein calibrating the gravitational assist model further comprises:

acquiring multiple current measurements at each of the predetermined rotational positions of the shafts; and calculating a gravitational supplement current for positions of the shafts from the current measurements.

* * * * *